US011339933B2

(12) United States Patent
Van Kirk

(10) Patent No.: US 11,339,933 B2
(45) Date of Patent: May 24, 2022

(54) UNIVERSAL LED FIXTURE MOUNT KIT

(71) Applicant: OPEN PLATFORM SYSTEMS LLC, Garden City, ID (US)

(72) Inventor: Michael Alexander Van Kirk, Garden City, ID (US)

( * ) Notice: Subject to any disclaimer, the term of this patent is extended or adjusted under 35 U.S.C. 154(b) by 0 days.

(21) Appl. No.: 17/092,169

(22) Filed: Nov. 6, 2020

(65) Prior Publication Data

US 2021/0131621 A1 May 6, 2021

Related U.S. Application Data

(60) Provisional application No. 62/931,610, filed on Nov. 6, 2019.

(51) Int. Cl.

| | |
|---|---|
| ***F21S 2/00*** | (2016.01) |
| ***F21V 19/00*** | (2006.01) |
| ***F21V 21/14*** | (2006.01) |
| *F21Y 115/10* | (2016.01) |

(52) U.S. Cl.

CPC ..... *F21S 2/005* (2013.01); *F21V 19/0045* (2013.01); *F21V 21/14* (2013.01); *F21Y 2115/10* (2016.08)

(58) Field of Classification Search

CPC . F21S 2/005; F21S 8/026; F21S 8/043; F21V 19/0045; F21V 21/14; F21V 19/003; F21V 19/005; F21V 19/0055; E04B 9/006

See application file for complete search history.

(56) References Cited

U.S. PATENT DOCUMENTS 3,218,446 A * 11/1965 Langer ..... F21V 19/02 362/86
3,737,654 A * 6/1973 Hawley ..... F21V 17/162 362/311.06
4,519,021 A * 5/1985 Oram ..... F21V 5/045 362/277
5,823,663 A * 10/1998 Bell ..... F21S 8/02 362/362
7,810,951 B1 * 10/2010 Lee ..... F21V 29/83 362/249.03
8,960,971 B1 * 2/2015 Newton ..... F21S 8/036 362/371

(Continued)

*Primary Examiner* — Bryon T Gyllstrom
*Assistant Examiner* — Christopher E Dunay

(57) ABSTRACT

A LED module mount, kit and method for mounting LED modules into lighting apparatuses, in particular for retrofit applications for retrofitting lighting apparatus frames with LED modules. Two module connectors connect to an LED module at opposite sides of the LED module so as to be in a parallel arrangement spaced apart by the LED module. Additional LED modules can be added to form a row of LED modules between the module connectors, with further rows of LED modules being added by adding a third and sequential modular connectors to stack rows of LED modules separated by a modular connector. One or more arms attaches to the modular connectors to connect the connectors to a light fixture. The arms are configured to be rotationally adjusted relative to the modular connectors to provide adjustability for accommodating varying light fixtures. The modular connectors and arms are configured to be adjusted in size, preferably by cutting the modular connectors and arms.

13 Claims, 9 Drawing Sheets

(56) References Cited

U.S. PATENT DOCUMENTS 9,004,715 B1 * 4/2015 Litke ..... A47B 47/0008 362/218
10,527,238 B1 * 1/2020 Huang ..... F21V 23/001
10,612,727 B1 * 4/2020 Green ..... F21V 23/003
10,697,626 B1 * 6/2020 Owens ..... F21V 29/74
10,918,021 B1 * 2/2021 Chen ..... A01G 7/045
D917,089 S * 4/2021 Rajasekaran ..... F21K 9/232 D26/63
10,976,015 B1 * 4/2021 Gershaw ..... F21S 8/026
2001/0024368 A1 * 9/2001 Henrici ..... F21S 2/005 362/235
2005/0072090 A1 * 4/2005 Mclaughlin ..... H02G 3/281 52/506.06
2008/0036397 A1 * 2/2008 Hockel ..... F21V 23/06 315/294
2008/0078524 A1 * 4/2008 Wilcox ..... F21V 29/75 165/11.1
2008/0080188 A1 * 4/2008 Wang ..... F21V 31/03 362/294
2009/0225546 A1 * 9/2009 Pearson ..... F21V 29/767 362/249.06
2010/0110687 A1 * 5/2010 Zheng ..... F21S 4/28 362/249.06
2010/0202144 A1 * 8/2010 Chen ..... F21V 19/0035 362/249.02
2010/0254132 A1 * 10/2010 Wassel ..... F21V 29/83 362/235
2010/0309664 A1 * 12/2010 Liu ..... F21S 8/086 362/235
2011/0136390 A1 * 6/2011 Gingrich, III ..... F21V 21/005 439/660
2011/0164421 A1 * 7/2011 Velazquez ..... F21S 2/00 362/249.11
2011/0170288 A1 * 7/2011 Kim ..... F21V 21/30 362/235
2011/0219650 A1 * 9/2011 Wright ..... G09F 13/22 40/559
2011/0286226 A1 * 11/2011 Van Horn ..... F21S 2/005 362/427
2012/0044685 A1 * 2/2012 Chen ..... G09F 13/22 362/249.02
2012/0113634 A1 * 5/2012 Wong ..... F21V 23/009 362/235
2012/0124874 A1 * 5/2012 Breihof ..... G09F 13/04 40/564
2012/0155080 A1 * 6/2012 Schupple ..... F21V 29/80 362/235
2012/0218758 A1 * 8/2012 Wang ..... F21S 8/086 362/244
2012/0275162 A1 * 11/2012 Spiro ..... F21V 29/74 362/294
2013/0003360 A1 * 1/2013 Igaki ..... F21V 17/164 362/184
2013/0027915 A1 * 1/2013 Caferro ..... F21V 29/507 362/147
2013/0077300 A1 * 3/2013 Meyer ..... F21S 2/005 362/235
2013/0148340 A1 * 6/2013 Shen ..... F21V 21/14 362/184
2013/0194803 A1 * 8/2013 Chen ..... F21V 21/00 362/249.01
2013/0235568 A1 * 9/2013 Green ..... F21V 29/74 362/218
2013/0272019 A1 * 10/2013 Engstrom ..... F21V 21/04 362/581
2014/0009946 A1 * 1/2014 Dohn ..... F21V 29/74 362/373
2014/0029260 A1 * 1/2014 Liu ..... F21V 29/763 362/249.02
2014/0085895 A1 * 3/2014 Frawley ..... F21V 19/02 362/249.03
2014/0268785 A1 * 9/2014 Quaal ..... G09F 13/08 362/249.08
2015/0055343 A1 * 2/2015 Liao ..... F21S 2/005 362/249.03
2015/0167948 A1 * 6/2015 Wasserman ..... F21S 2/005 362/249.01
2015/0198298 A1 * 7/2015 Scarlata ..... F21S 9/00 362/184
2015/0300610 A1 * 10/2015 DeCarr ..... F21S 8/061 362/249.07
2016/0040837 A1 * 2/2016 Kallas ..... H05B 45/00 315/152
2016/0109079 A1 * 4/2016 McKinley ..... F21V 21/30 362/89
2017/0074474 A1 * 3/2017 Bailey ..... F21V 17/16
2017/0108184 A1 * 4/2017 Brannon ..... F21V 29/763
2017/0108202 A1 * 4/2017 Mundle ..... F21S 2/005
2017/0146203 A1 * 5/2017 Belaidi ..... H05B 45/60
2018/0010778 A1 * 1/2018 Zhao ..... F21V 23/002
2018/0056205 A1 * 3/2018 Lu ..... A63H 33/042
2018/0274735 A1 * 9/2018 Vidal ..... F21V 23/008
2018/0320846 A1 * 11/2018 Sozzi ..... F21S 2/005
2019/0003660 A1 * 1/2019 Jang ..... F21V 5/007
2019/0113464 A1 * 4/2019 Tingle ..... F21V 21/30
2019/0346116 A1 * 11/2019 Gomez Martinez .... F21S 2/005
2019/0383473 A1 * 12/2019 Agro ..... F21V 23/06
2020/0032990 A1 * 1/2020 Li ..... F21V 29/74
2020/0053967 A1 * 2/2020 Murphy ..... F21S 2/005
2020/0173639 A1 * 6/2020 Martin ..... H05K 1/056
2020/0263859 A1 * 8/2020 Kinsley ..... F21V 23/06
2020/0284404 A1 * 9/2020 Nowak ..... F21S 4/28
2020/0318820 A1 * 10/2020 Norton ..... F21V 21/14
2020/0385987 A1 * 12/2020 Yeo ..... E04B 9/067
2020/0393093 A1 * 12/2020 Wang ..... F21V 17/12
2021/0071832 A1 * 3/2021 Gomez Martinez .. F21V 21/008
2021/0325028 A1 * 10/2021 Huang ..... F21V 29/74

* cited by examiner

UNIVERSAL LED FIXTURE MOUNT KIT

PRIORITY/CROSS-REFERENCE TO RELATED APPLICATIONS

This application claims the benefit of U.S. Provisional Application No. 62/931,610, filed Nov. 6, 2020 the disclosure of which is incorporated by reference.

TECHNICAL FIELD

The presently disclosed technology relates to a mounting kit for light assemblies More particularly, the present invention is a mounting kit for a light assembly for use in retrofitting light fixtures with one or more LED (Light Emitting Diode) modules.

BACKGROUND

Business owners wanting to replace old HID (high intensity discharge) lights and retrofit their parking lot light fixtures or other light fixtures to LED modules have very few options. There is a myriad of different fixture housings with interior mounting bosses that follow no specific pattern which also makes a universal design difficult and limits the type of retrofit kit a customer can use. Current market solutions often have low life spans, are difficult to install, or require multiple trips by electricians with bucket trucks or lifts to measure for custom plates, resulting in added cost to the business owner. Current mounting solutions can also limit the available wattages for the retrofit. Another disadvantage is that some of the mounting kits only work with certain light fixture types.

Examples of current retrofit mounts are shown in FIGS. 1-5. As illustrated the retrofit mounts come in a variety of shapes and sizes to facilitate a different sized light fixture. Accordingly, what is needed is a mount, kit, and method for retrofitting light fixtures with LED modules and providing for the ability to accommodate retrofitting a variety of different shaped and/or sized light fixtures with a single mount or kit.

SUMMARY OF THE INVENTION

The purpose of the summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the inventive concept(s) of the application, which is measured by the claims, nor is it intended to be limiting as to the scope of the inventive concept(s) in any way.

In a preferred embodiment, the Universal LED Fixture Mount Kit has an arm and a connector. Both components are configured such that the resulting functionality aspect allows the modules to be retrofitted into virtually any existing commercial light fixture.

The connector joins the led modules together and preferably contains multiple slots to allow different configurations. The slots also allow for points on which the arm can be connected.

In a preferred embodiment, the arm connects the module assembly to the light fixture housing. The arm preferably contains multiple slots which allow multiple connection points to the fixture. The arm preferably has a single connection point which allows it to swivel when connected to facilitate different mounting positions.

In a preferred embodiment, the combination of slots and rotational movement of the arm allows for a multitude of configurations in which it can be set up and installed into a light fixture. This allows for easing the retrofit process and reducing the time it takes to install a retrofit solution while still keeping the efficiency and longevity that is expected from LED's.

In a preferred embodiment, the arm and the connector are constructed of PA6,6-RG251 plastic, a UL listed glass filled nylon. The mechanical and thermal properties of the material allow for the support the LED modules and have a high thermal deformation point.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the description of the preferred embodiments is to be regarded as illustrative in nature, and not as restrictive in nature.

DETAILED DESCRIPTION OF THE INVENTION

Figure 1:
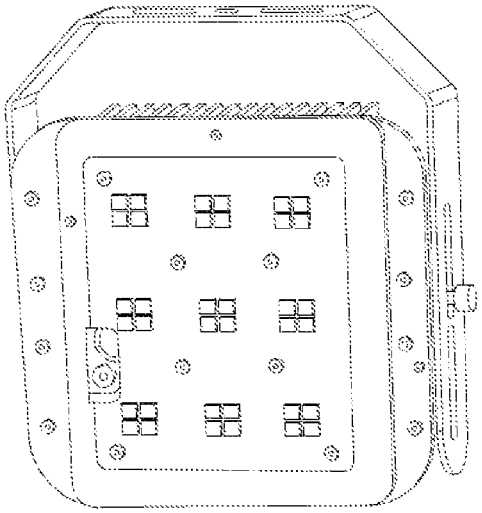
FIG. 1 illustrates a prior art retrofit mount.
Figure 2:
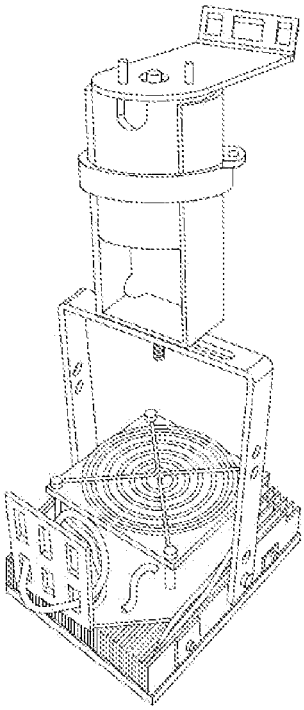
FIG. 2 illustrates a prior art retrofit mount.
Figure 3:
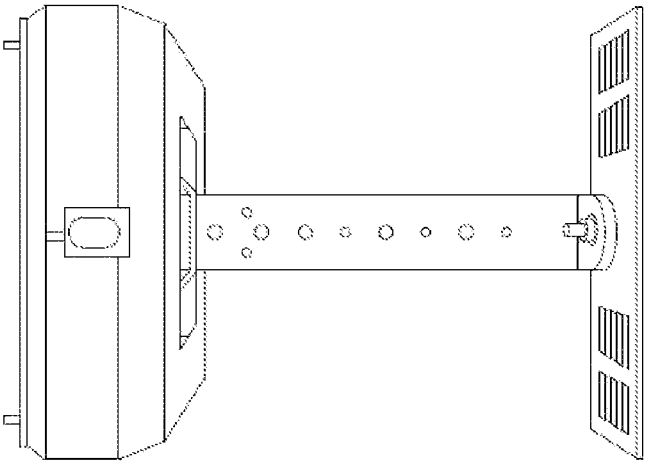
FIG. 3 illustrates a prior art retrofit mount.
Figure 4:
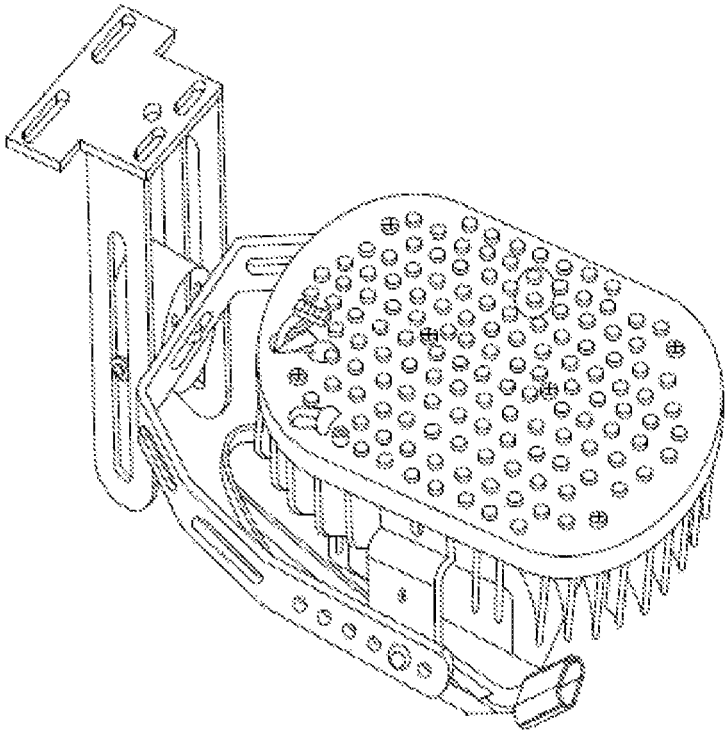
FIG. 4 illustrates a prior art retrofit mount.
Figure 5:
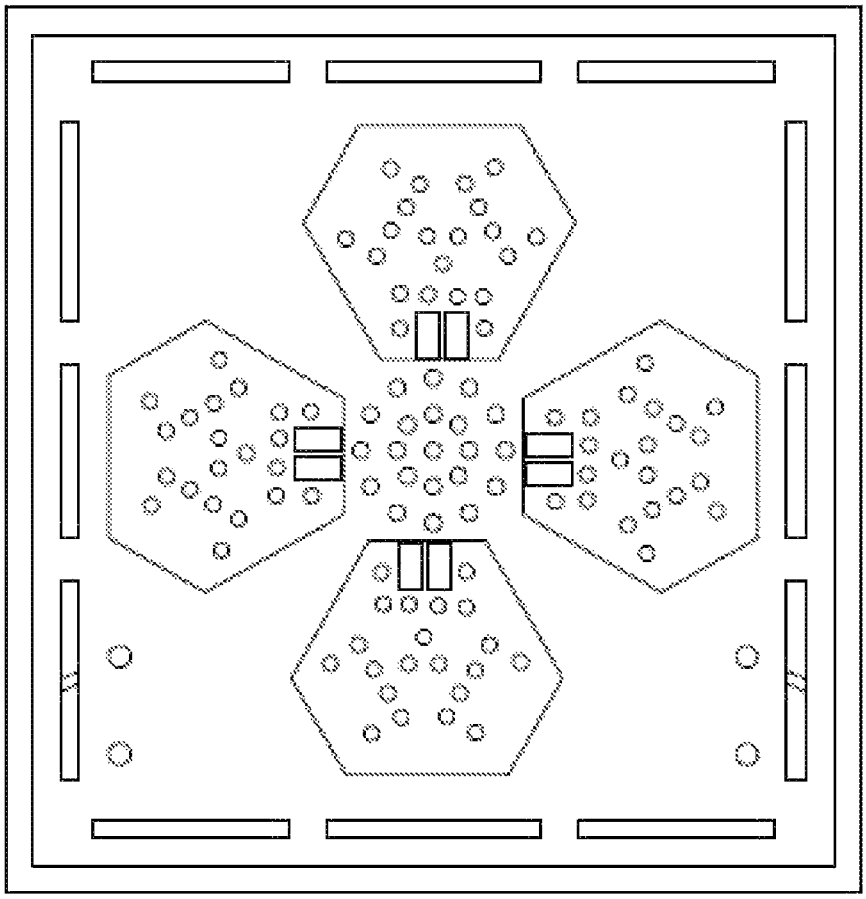
FIG. 5 illustrates a prior art retrofit mount.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined herein.

Figure 6:
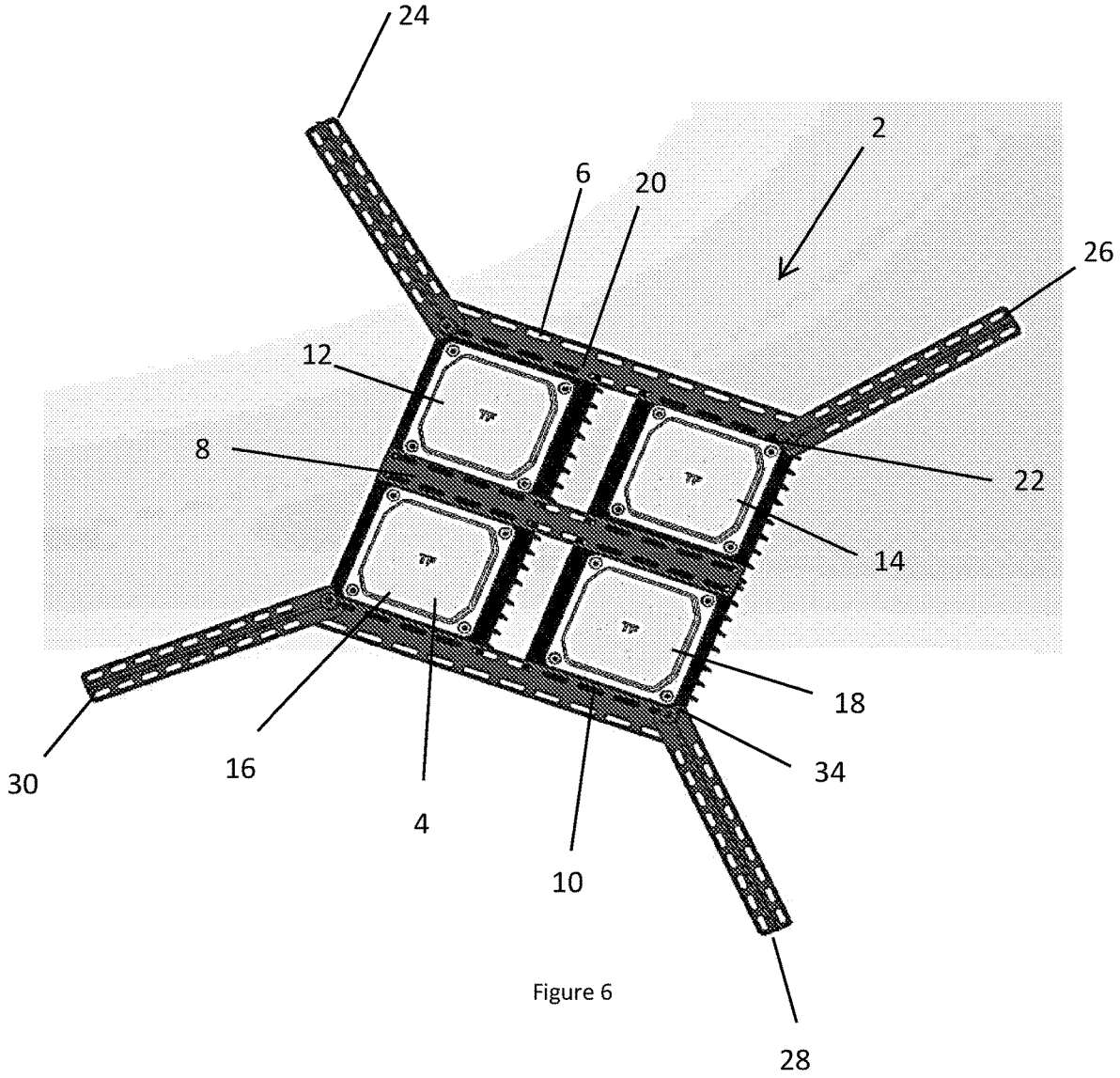
FIG. 6 illustrates an LED retrofit mount having four LED modules arranged in a square shape.

What is disclosed is a Universal LED Fixture Mount that is configured to fit almost any light housing. FIG. 6 illustrates a LED retrofit mount 2 having four LED modules 4 the led modules are connected by three module connectors 6, 8, 10. The module connectors extend between adjacent LED modules. In the depicted embodiment, the first connector 6 connects to LED modules 12, 14. A third connector 10 is attached to the second pair of LED modules on opposite sides of the LED modules from the middle connector 8. Each connector has a series of slots a first series of slots 20 and a second series of slots 22. The parallel series of slots are separated on one side by a ridge such that the connector has a general T-shape. The parallel slotted openings are positioned in the opposing flanges of the T-shape. The web (or ridge) is configured to be positioned against the edge of the LED module. Each LED module is then attached to the connector via mounting connectors such as screws or bolts. The T-shaped connector is configured to be cut to provide varying lengths such that different arrangements of LED modules can be utilized.

FIG. 6 is shown with four arms 24,26,28,30. The arms are connected to a LED Module (e.g. 14) through a boss positioned at the end of each arm. The arm connector 34 serves to attach the first end of each arm to a module connector. The boss and arm are configured such that when the arm is connected via at the first end to the module connector, the arm can be rotated to provide a different angle of the arm relative to the connector. This allows the arm to be varied in orientation for attachment to varying preexisting lighting fixtures. The arms are configured to be cut in length to further facilitate attachment in varying lighting fixtures. The modularity of the LED modules coupled with the ability to re configure the arrangement of the LED modules, orientation of the arms, and length of the arms and module connectors allows for the retrofit kit to be utilized in a wide variety of LED light fixtures. The light kit can be sold as a one or more module connectors, one or more arms that could be cut in length, and could be utilized with separately sold or included LED modules. The second end of each arm is then or alternatively at a position between the first end and the second end of the arm, is attached to the LED light fixture. This allows the LED modules to be positioned in the light fixture so as to replace any prior bulb apparatus.

Figure 9:
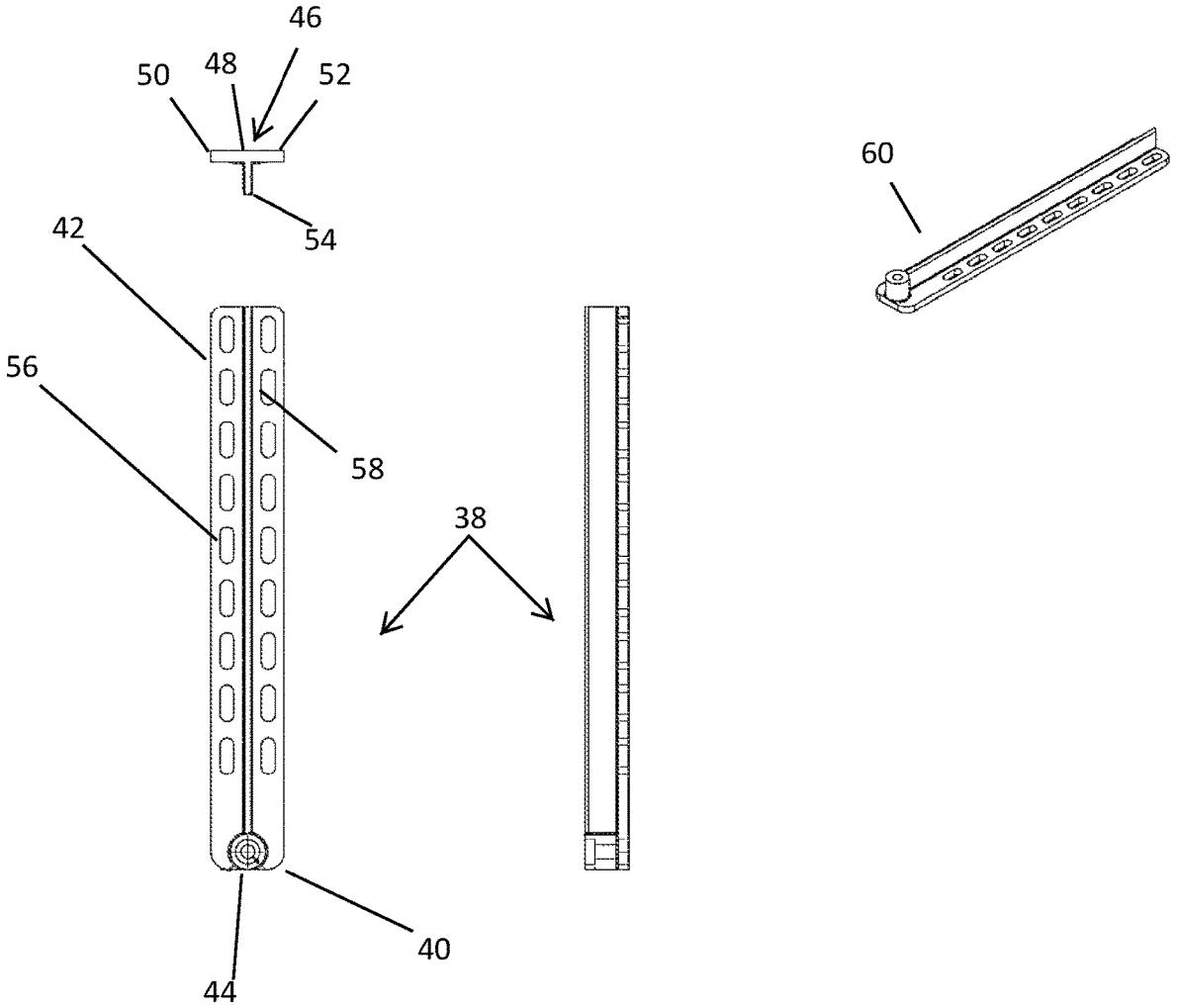
FIG. 9 illustrates a preferred embodiment of an arm of an LED retrofit mount.

FIG. 9 illustrates a preferred embodiment of an arm for connecting the LED fixture mount kit to a light fixture. The arm 38 has a first end 40 and a second end 42 at the first end is a boss 44 the arm has a general T-shape 46 having a flange 48 having a first flange side 50 and a second flange side 52 separated by a web or ridge 54 extending from the flange. Two parallel series of slotted openings 56, 58 extend along the flange on opposing side of the web of the T-shape of the flange. A connector 60 is provided to attach the first end of the arm at the boss to the module connector.

The arm is preferably an injection molded part that is T-shaped measuring approximately 6.4" long. There are preferably 18 holes that measure approximately 0.41"×0.16" and have an approximately 0.08" radius. It is understood that various numbers of holes can be used. The holes are preferably used to mount to the inside of the light fixture at various locations and are slotted to allow for further adjustment. The arm preferably has a boss at one end that measures approximately 0.50" high with an outer radius of approximately 0.22" and an inner hole that measures approximately 0.16". The arm is preferably countersunk on both sides to allow the screw head to recess. The arm preferably has a rib that runs longitudinally along the arm and measures 0.37" high and 0.07" thickness, which limits deflection in the part. The part is preferably constructed of PA6,6-RG251 plastic, a UL listed glass filled nylon. It is well understood that the arm can be constructed of other materials with similar properties.

Figure 7:
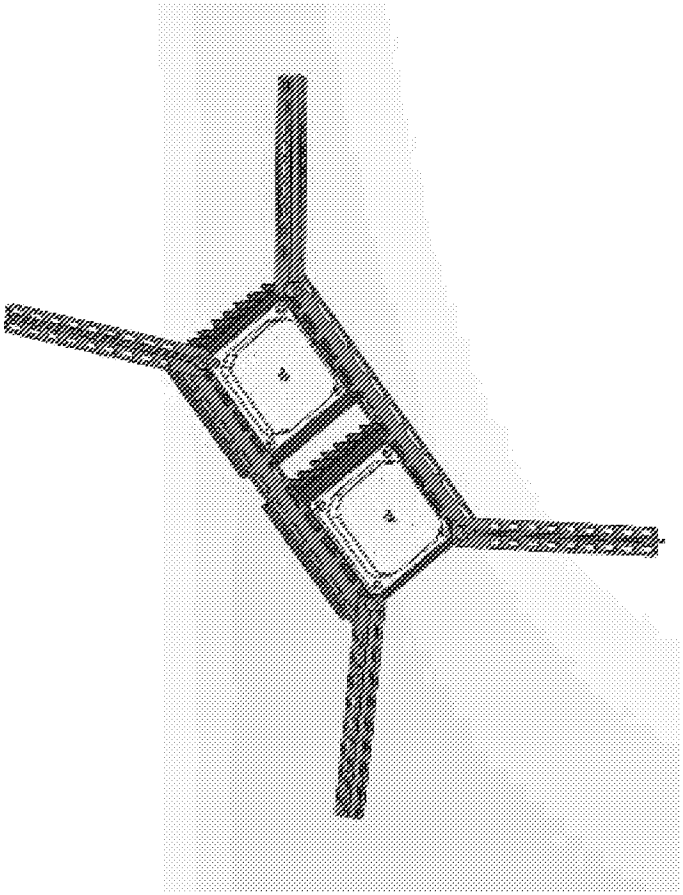
FIG. 7 illustrates an LED retrofit mount having two LED modules.
Figure 8:
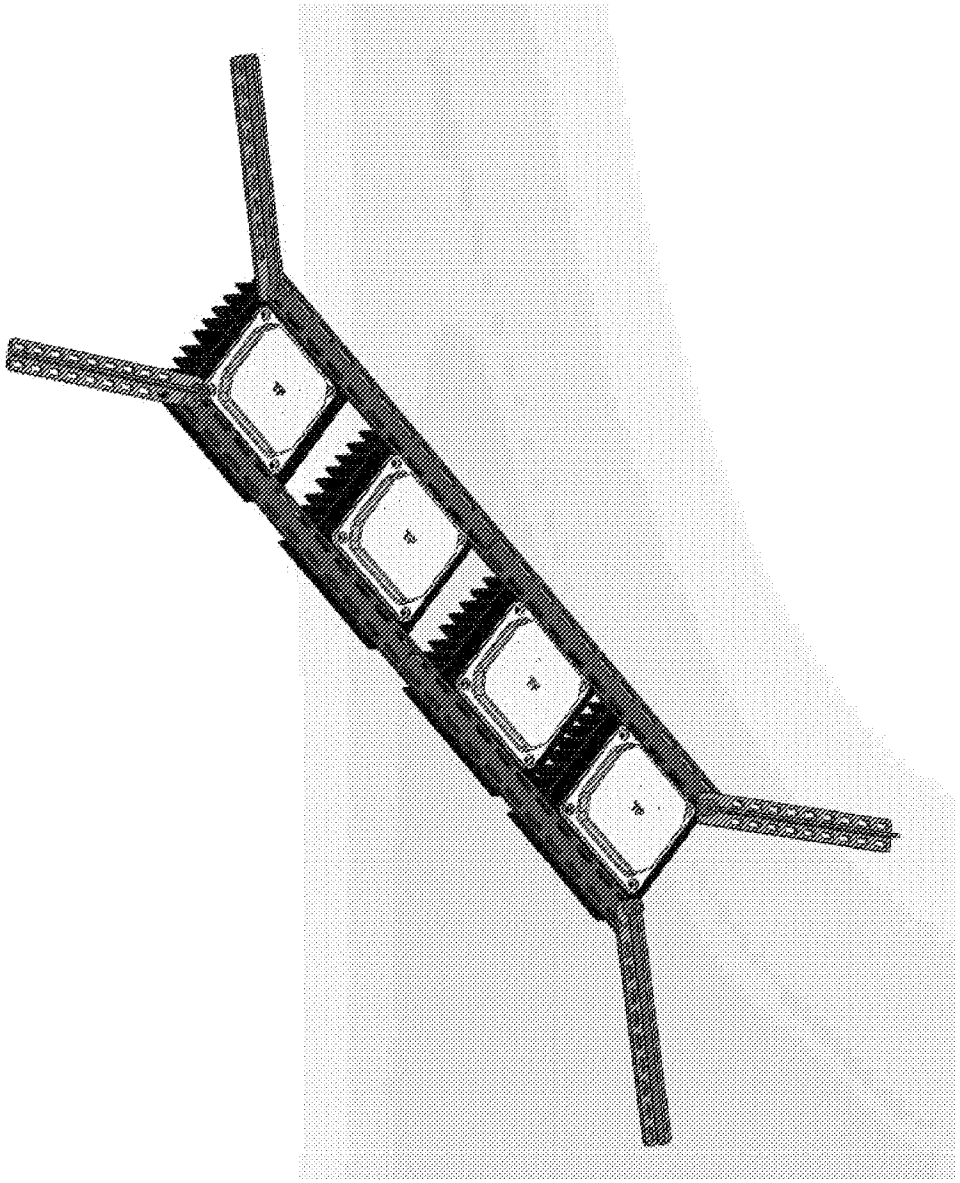
FIG. 8 illustrates an LED retrofit mount having four LED modules arranged in a linear shape.
Figure 10:
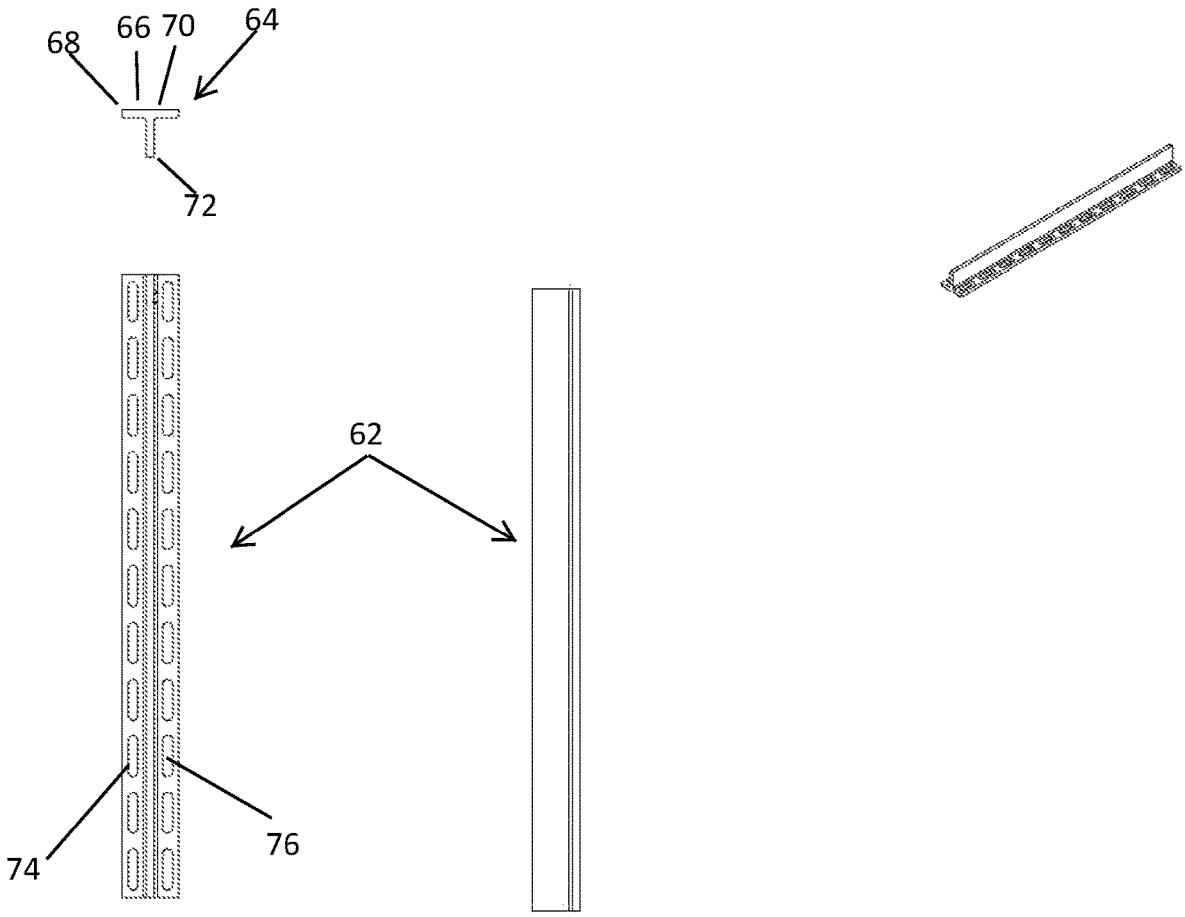
FIG. 10 illustrates a preferred embodiment of a module connector of an LED retrofit mount.

FIG. 10 illustrates a module connector 62. The module connector has a general T-shape 64 the general T-shape has a flange 66 having opposing sides 68, 70 separated by a web or ridge 72. The flange has a series of parallel slotted openings 74, 76 that provide attachment points for an LED module to the flange as well as for the first end of an arm to attach to the flange. Providing two parallel rows of slotted openings allows for a module connector to connect to one or more LED module at the first row of slotted openings and to one or more LED modules (as shown, for example, in FIG. 6) and/or arms (as shown, for example, in FIG. 7) at the second row of slotted openings. The module connector slotted openings are spaced such that multiple modules can be arranged sequentially on a module connector. The module connector can be configured to be cut to reduce the length of a module connector or to divide a module connector into two or more module connectors.

In a preferred embodiment, the module connector is an injection molded part that is T-shaped measuring approximately 9.88" long and 0.75" high, with a wall thickness of approximately 0.13". The module connector preferably has 22 holes that measure approximately 0.65"×0.15" and have an approximately 0.08" radius. It is understood that various numbers of holes can be used. The module connector holes allow the modules to be joined with various spacing and provides additional mounting places for the arms to connect to. The module connector preferably has a longitudinal rib or web that measures approximately 0.63" high with a thickness of approximately 0.13" and preferably runs the length of the module connector, to limit the deflection along the axis parallel to the rib. The module connector is preferably constructed of PA6,6-RG251 plastic, a UL listed glass filled nylon. It is well understood that the arm can be constructed of other materials with similar properties.

Figure 11:
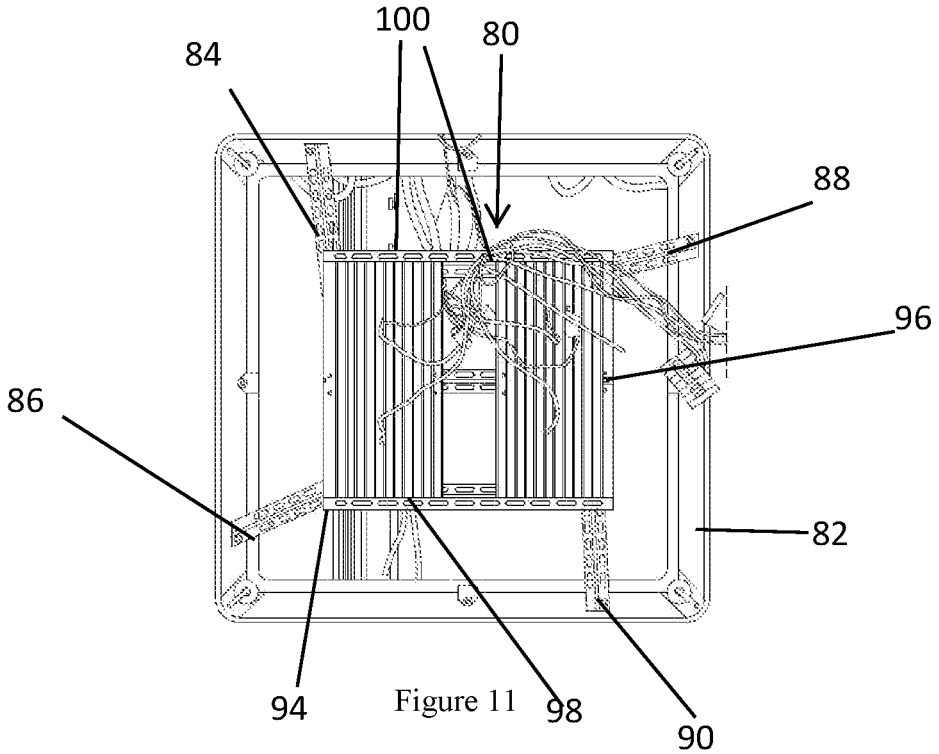
FIG. 11 illustrates a top view of an LED retrofit mount kit attached to light
Figure 12:
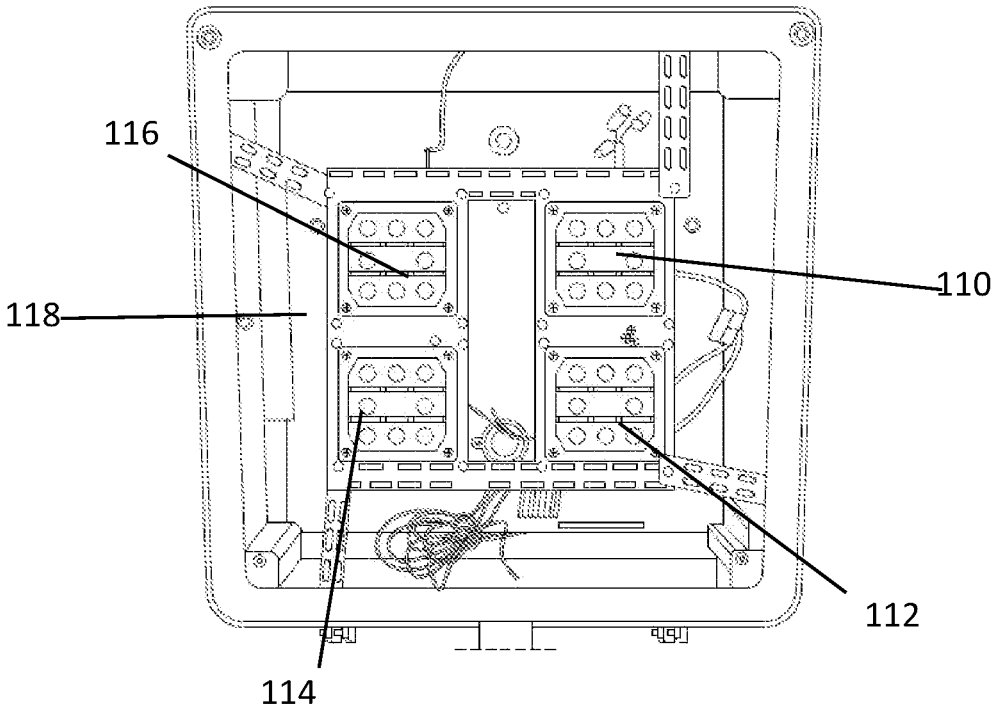
FIG. 12 illustrates a view of an LED retrofit mount kit attached to a light fixture.

FIGS. 11 and 12 illustrate an embodiment of a LED light module retrofit kit 80 attached to a preexisting light fixture 82. Four arms 84,86,88,90 connect the outer two module connectors 92, 94 to the light fixture. A central connector 96 connects opposing pairs of LED modules 98, 100. The first outer module connector 92 provides the structure to connect a pair 100 of LED modules to the light fixture. FIG. 13 illustrates an installed LED light module kit in a light fixture with the LED modules 110, 112, 114, 116 illuminating through a glass or plastic cover.

In a preferred embodiment, the combination of the slots in both arms with the circular motion of the arms allows this attachment method to be used in any fixture as it does not require any specific mounting boss to be present in the light fixture. Multiple wattages are possible due to the symmetrical design, allowing more led modules to be connected.

In a preferred embodiment, the arms can be flipped 180 degrees for mounting to the lens frame. Both the arms and the module connector can be trimmed to fit with a hacksaw, diagonal cutting pliers or other shortening methods known in the art, allowing it to be shortened with ease. In a preferred embodiment, the glass lens is able to stay in the fixture as well and doesn't affect the performance of the universal mount.

In a preferred embodiment, the ease at which the arms can be trimmed provides for adaptability of the unit.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

I claim:

1. An LED fixture mount kit configured for installation of LED modules into a light fixture, said LED fixture mount comprising:

a first module connector and a second module connector, wherein said first module connector and said second module connector each comprises a first end and a second end and a length extending between said first end and said second end, wherein said first module connector and said second module connector are configured to attach to a plurality of LED modules on opposing sides of said LED modules such that said first module connector and said second module connector are in a parallel arrangement spaced apart by said LED modules such that said LED modules are positioned in a first row;

wherein said first module connector and said second module connector are configured to be cut to reduce the length of said first module connector and said second module connector; and a plurality of arms, wherein each of said arms comprises a first end and a second end and a length extending between said first end and said second end, wherein each of said arms is configured to attach at a first arm end to one of said first module connector and said second module connector, wherein said arms are configured to attach at a second arm end to said light fixture, wherein said arms are configured to be cut to reduce the length of each arm to accommodate mounting said LED light kit in a variety of sizes and shapes of light fixtures.

2. The LED fixture mount kit of claim 1, wherein said fixture mount kit comprises a plurality of LED modules.

3. The LED fixture mount kit of claim 1, wherein said fixture mount kit comprises a third module connector, wherein said third module connector is configured to add a second row of LED modules positioned between said second module connector and said third module connector.

4. An LED fixture mount configured for installation of LED modules into a light fixture, said LED fixture mount comprising:

a first module connector and a second module connector, wherein said first module connector and said second module connector each comprises a module connector first end and a module connector second end a length extending between said module connector first end and said module connector second end, wherein each of said module connectors comprises an inner row of spaced apart slots extending along said length of each of said module connector sand an outer row of spaced apart slots extending along at least a portion of said length of each of said module connectors in a parallel orientation to said first series of spaced apart slots, where each series of spaced apart slots is configured for attaching said connector to one or more LED modules;

at least one arm, said at least one arm comprising a first arm end and a second arm end and a length extending between said first arm end and said second arm end, wherein said arm is configured to attach to said module connector at said first arm end and to attach to the light fixture at said second arm end; and at least one LED module mounted to said first and second module connectors such that said first and second module connectors are arranged in a parallel orientation with said LED module positioned between said module connectors, wherein said LED module is mounted on a first side by at least one connector extending through a slot in said inner row of slots in said first module, wherein said LED module is mounted on a second side by at least one connector extending through a slot in said inner row of slots in said second module, wherein said arm attaches at said first end by an arm connector extending through said first end of said arm and attaching to a slot in said outer row of slots in either said first module connector and said second module connector, wherein said first end of said arm connector is configured to attached to said module connector in a plurality of rotational positions.

5. The LED fixture mount of claim 4, wherein said at least one arm comprises a first series of spaced apart slots extending along said length of said module connector and a second series of spaced apart slots extending along said length of said module connector in a parallel orientation to said first series of spaced apart slots, wherein said arm is configured to attach to a light fixture housing at each of said plurality of openings extending between a point between said first end and said second end and said second end, wherein said arm is configured such that said arm can be cut between said openings to reduce the length of said arm, wherein said second end of said arm is configured to attach to each of said module connectors at each of said parallel openings.

6. The LED fixture mount of claim 4, wherein said module connector comprises a T shape having a flange and a web, wherein said two rows of parallel slotted openings are separated by said web.

7. The LED fixture mount of claim 4, wherein said arm comprises a T shape having a flange and a web, wherein said two rows of parallel slotted openings in said arm are separated by said web.

8. The LED fixture mount of claim 4, wherein said LED fixture mount comprises four arms.

9. The LED fixture mount of claim 4, wherein said LED fixture mount comprises a third module connector, wherein said third module connector comprises an inner row of spaced apart slots extending along at least a portion of said length of said third module connector and an outer row of spaced apart slots extending along at least a portion of said length of each of said third module connector in a parallel orientation to said first series of spaced apart slots, where each series of spaced apart slots is configured for attaching said connector to one or more LED modules, wherein said third module connector is arranged in a parallel orientation to said second module with an LED module extending between said second module connector and said third module connector and connected on a first side to said second module connector via at least one slot in said outer row of slots of said second module connector and connected on a second side to said third module connector via at least one slot in said inner row of slots of said third module connector.

10. The LED fixture mount of claim 4, wherein said first arm end comprises a buss, wherein said kit comprising an arm connector configured to seat in said buss and extend through said opening in said outer row of slots in said first module or said second module.

11. The LED fixture mount of claim 4, wherein said LED fixture mount comprises a plurality of LED modules attached to said module connectors in a lineal arrangement.

12. The LED light fixture of claim 11, wherein said LED modules are arranged in a square or rectangular shape.

13. The LED light fixture of claim 4, wherein arm is configured to attach to said light fixture frame by a screw extending through one of said slots in said arm and connecting to said light fixture frame.

* * * * *